US008342983B1

(12) United States Patent
Jeffres

(10) Patent No.: US 8,342,983 B1
(45) Date of Patent: Jan. 1, 2013

(54) GOLF PUTTER

(75) Inventor: Daniel C. Jeffres, Wyoming, NY (US)

(73) Assignee: D&M Precision, LLC, Wyoming, NY (US)

( * ) Notice: Subject to any disclaimer, the term of this patent is extended or adjusted under 35 U.S.C. 154(b) by 261 days.

(21) Appl. No.: 12/754,484

(22) Filed: Apr. 5, 2010

Related U.S. Application Data

(60) Provisional application No. 61/180,324, filed on May 21, 2009.

(51) Int. Cl.
*A63B 53/00* (2006.01)

(52) U.S. Cl. ..... 473/340; 473/407; 473/286; 473/257; 473/266; 473/242

(58) Field of Classification Search ..... 473/286, 473/340–341, 328, 324, 219, 226, 257, 266, 473/268, 231, 238, 242, 251–255, 243, 407
See application file for complete search history.

(56) References Cited

U.S. PATENT DOCUMENTS 4,000,902 A 1/1977 Perkins
5,603,668 A * 2/1997 Antonious ..... 473/328
5,967,902 A 10/1999 Greenquist et al.
6,322,457 B1 11/2001 Klein
6,634,956 B1 10/2003 Pegg
8,021,247 B2 * 9/2011 Brolly ..... 473/340
8,152,649 B2 * 4/2012 Bittner ..... 473/265
2007/0105645 A1 * 5/2007 Thompson ..... 473/328

* cited by examiner

*Primary Examiner* — Stephen L. Blau
(74) *Attorney, Agent, or Firm* — Patent Innovations LLC; John M. Hammond

(57) ABSTRACT

A golf putter comprising a body including a front face, and a rearward member joined to and extending rearwardly from the body and comprising a lower region, and a first cleat and a second cleat extending downwardly from the lower region. The first and second cleats may be positioned to extend downwardly along first and second cleat axes, such that a line segment extending between the cleat axes is parallel to the front face of the club body. The putter may be further comprised of a shaft joined to a top portion of the body and having a central axis which intersects a line segment extending from a junction of the first cleat with the lower region of the rearward member to a junction of the second cleat with the lower region of the rearward member. The central axis of the shaft may be substantially perpendicular to the line segment.

20 Claims, 10 Drawing Sheets

GOLF PUTTER

CROSS-REFERENCE TO RELATED PATENT APPLICATIONS

This application claims priority from U.S. provisional patent application Ser. No. 61/180,324, filed May 21, 2009, the disclosure of which is incorporated herein by reference.

BACKGROUND OF THE INVENTION

1. Field of the Invention

Golf clubs; more particularly, a golf putter used for striking and directing a golf ball from a location on the surface of a green towards and into a golf hole.

2. Description of Related Art

In the game of golf, it is commonly known that the play of a golf hole is usually concluded with putting, in which the golf ball is disposed upon a closely cropped grass surface (the green), and the golfer strikes the golf ball with a generally flat-surfaced golf club (a putter) and directs the ball towards (and hopefully into) the golf hole. The act of putting a golf ball in an accurate manner is one of the most challenging strokes in the game. it is commonly accepted, observed, and directly experienced that many golf tournaments (and wagers among friends) are won or lost "on the green."

An effective stroke of a golf putter requires a high degree of hand-eye coordination, steady hands, arms, shoulders, trunk, and legs, and precise judgment with regard to how fast to move the putter head when striking the ball, in order to advance the ball to the hole, but have it arrive there are a relatively low speed, such that it will fall in if it reaches the hole rather than pop out or "rim out." There is furthermore a second component with regard to the judgment of the golfer, which is club and stroke alignment. The golfer must properly align the surface of the putter substantially perpendicular to the "line" on the green that he wants the ball to follow. If the green is very level, the line may be directly to the hole; if not, the golfer will choose another line to allow for the slope of the green and the resulting curved trajectory of the path of the ball.

In any case, the golfer chooses a line for his putt. This is often done from a squatting position behind the ball, such that the golfer observes lines of sight along the green, and the various trajectories that the ball might take. Once the golfer chooses his "line," he then rises to a standing position, and takes a few steps to the side of the ball to assume his putting stroke position. The golfer then looks down at his ball and aligns the face of his putter perpendicular to the line that he chose when squatting a few seconds previously. At this point, he has to rely on his memory, intuition, instinct, or "gut feel"—however one might describe the mental process—to achieve that alignment. He may look back and forth to the hole, or to the target location at a distance along his perceived line, but he no longer has a precise knowledge of his line. Because the putter head, which must be positioned perpendicular to the line, is only about four to six inches wide, it is difficult to judge whether that perpendicularity has been attained as he begins his putting stroke.

This alignment portion of the judgment in executing a putting stroke is thus one of the greatest sources of error in the act of putting. Most current putters are similar with regard to alignment of the putter head prior to the putting stroke, in that they have a line, groove, circle or other indicia located on the putter head to use as an alignment aid. This indicia can obviously be no longer than the thickness of the putter head, and is thus of relatively little help in making an accurate putting stroke. What is needed to address the alignment problem is a golf putter that can assist the golfer in aligning the putter face perpendicular to the line, thereby enabling a more accurate putt that follows the desired trajectory on the green, and into the hole.

SUMMARY

In accordance with the present disclosure, the problem of aligning a putt in golf is solved by using a golf putter comprising a body including a front face, and a rearward member joined to and extending rearwardly from the body and comprising a lower region, and a first cleat and a second cleat extending downwardly from the lower region. The first and second cleats may be positioned to extend downwardly along first and second cleat axes, such that a line segment extending from the first cleat axis to the second cleat axis is parallel to the front face of the club body. The golf putter may be further comprised of a shaft joined to a top portion of the body and having a central axis which intersects a line segment extending from a junction of the first cleat with the lower region of the rearward member to a junction of the second cleat with the lower region of the rearward member. The central axis of the shaft may be substantially perpendicular to the line segment. The central axis of the shaft may bisect the line segment.

The rearward member of the golf putter may be comprised of a first elongated rod, a second elongated rod, and a rearward block joined at a front edge thereof to the first and second elongated rods. The first and second elongated rods and the rearward block may form means for engaging with and removing a golf ball from a surface beneath the body of the golf club. In one embodiment, the first and second rods may be substantially parallel, with the distance between the first and second elongated rods being slightly less than the diameter of a golf ball, so as to cause an interference fit of the golf ball between the first and second elongated rods when the club body and rearward member are forced downwardly over a golf ball disposed between the first and second elongated rods. In another embodiment, the first elongated rod, the second elongated rod, and the rearward block may be dimensioned and arranged so as to cause an interference fit of a golf ball between at least two of the first elongated rod, the second elongated rod, the front edge of the rearward block, and a rearward surface of the club body when the club body and rearward member are forced downwardly over a golf ball disposed between the first and second elongated rods.

In using the instant putter, a golfer aligns himself behind the golf ball on the green, facing the general direction towards which he will direct his putt. The golfer gets in a lowered position, such as squatting, and holds the putter with the club head disposed on the surface of the green, and with the club shaft aligned with the golf ball on the green, and aligned with the putting line that he chooses. The golfer then slowly raises the distal (grip) end of the putter up. The cleats extending downwardly from the lower region of the club head bite into the surface of the green, preventing the club head from moving, and thereby maintaining the alignment of the club head with respect to the putting line chosen by the golfer. When the putter shaft is fully raised, i.e. at the "12 o'clock" position, the golfer steps to the heel side of the putter, grips the club shaft, and assumes a putting stance, moving the club shaft slightly towards himself. The alignment of the club face substantially perpendicular to the putting line is maintained. The golfer then executes the putt.

BRIEF DESCRIPTION OF THE DRAWINGS

The present disclosure will be provided with reference to the following drawings, in which like numerals refer to like elements, and in which.

Figure 1:
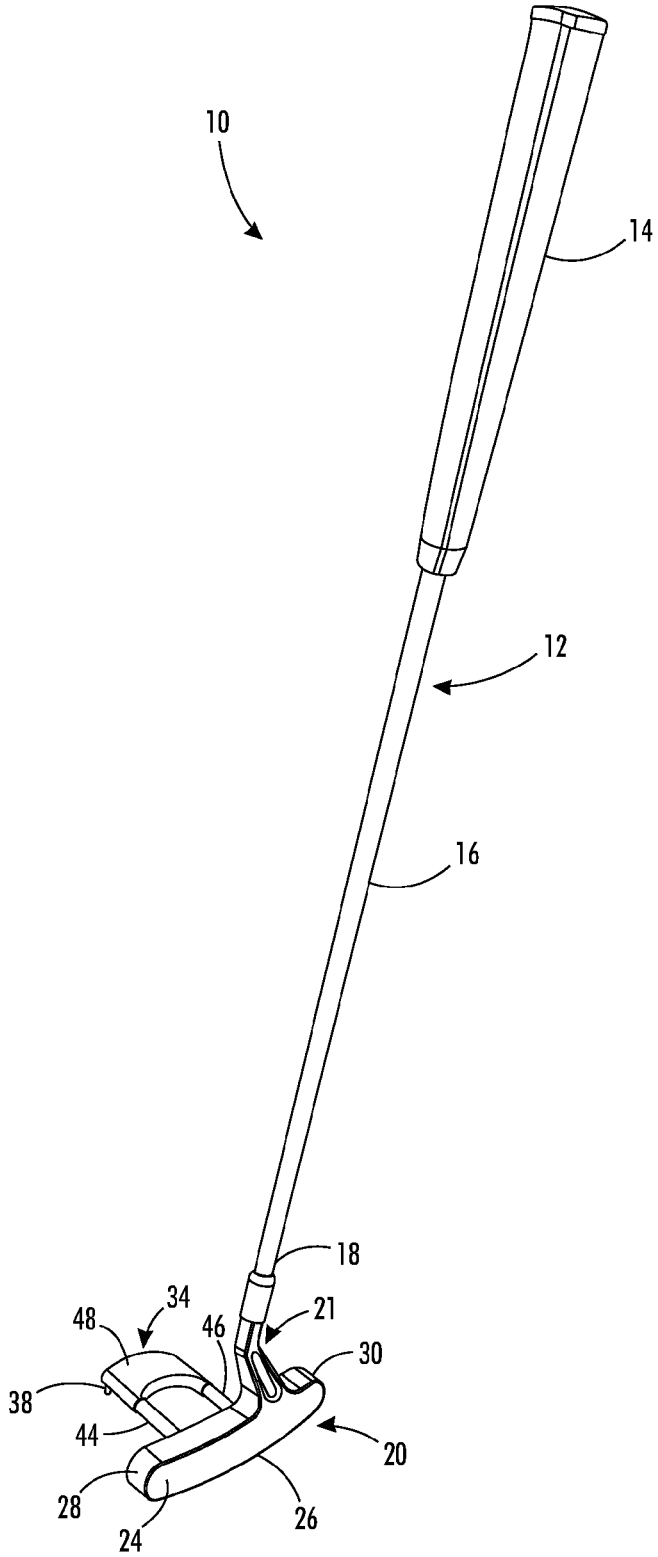
FIG. 1 is a front perspective view of a golf putter of the present disclosure.

The present invention will be described in connection with a preferred embodiment, however, it will be understood that there is no intent to limit the invention to the embodiment described. On the contrary, the intent is to cover all alternatives, modifications, and equivalents as may be included within the spirit and scope of the invention as defined by the appended claims.

DETAILED DESCRIPTION

For a general understanding of the present invention, reference is made to the drawings. In the drawings, like reference numerals have been used throughout to designate identical elements. For the sake of clarity of this disclosure, certain terms are used to indicate certain parts or regions of the applicant's golf putter. The "front" side of the golf putter body or head, including the front face of the club body, is considered to be the side which makes contact with a golf ball when a putt is performed. The "rearward" side of the putter body is the side that is opposite the front side. The "heel" side, including a lateral heel surface, is the lateral side of the putter body which is most proximate to the golfer when the golfer is in the act of putting. The "toe" side, including a lateral toe surface, is the lateral side of the putter body which is most distal from the golfer when the golfer is in the act of putting. The bottom of the club body is the lowermost region including a bottom surface, which is typically in contact with the green immediately prior to the act of putting.

In FIGS. 1-11, "right handed" putters are depicted, i.e., putters for use by a right handed golfer. It is to be understood that "left handed" embodiments of the instant putters may also be provided, which are simply mirror images of the putters depicted in FIGS. 1-11. Additionally, in this disclosure, the exemplary golf club of the present invention that is shown and described is a putter. The present invention is not limited solely to putter-type golf clubs. To the contrary, other types of golf clubs, such as drivers, irons, and wedges are also included within the scope of the present invention, as described only by the appended claims.

Turning now to FIGS. 1-6, the golf club or golf putter 10 is comprised of a club shaft 12, which is joined to a club body 20. The shaft 12 may be of various lengths, depending upon the height of the golfer, as well as the golfer's putting stroke and personal preference. The shaft 12 is preferably straight, having a central axis 11, so as to enable the golfer to align the club 10 with the putting line that he chooses in performing a putt, as will be explained presently. The shaft 12 is further comprised of a grip 14, and an elongated tubular or solid rod section 16. The shaft 12 may be also be tapered from the grip end to the club body end.

The club body 20 includes a front face 24, a bottom surface 26, a toe lateral surface 28, a heel lateral surface 30, and a rearward surface 32. A rearward member 34 extends rearwardly from the body 20. The rearward member 34 includes a lower region 36, and a first cleat 38 and a second cleat 40 extending downwardly from the lower region 36. The first and second cleats 38 and 40 may have first and second cleat axes 39 and 41 (FIG. 6), such that a line segment 42 extending from the first cleat axis 39 to the second cleat axis 41 is parallel to the front face 24 of the club body 20. The first and second cleats 38 and 40 may be disposed proximate to the distal end 43 of the rearward member 34.

Figure 2:
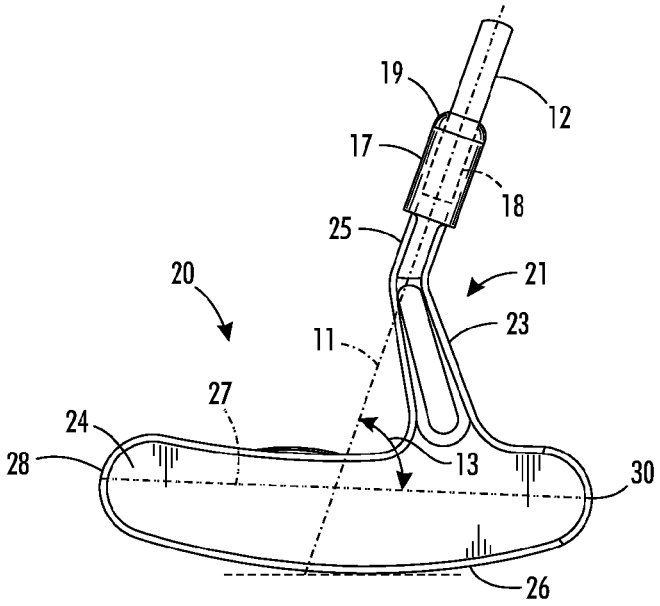
FIG. 2 is a front elevation view of the club body of the golf putter of FIG. 1.
Figure 3:
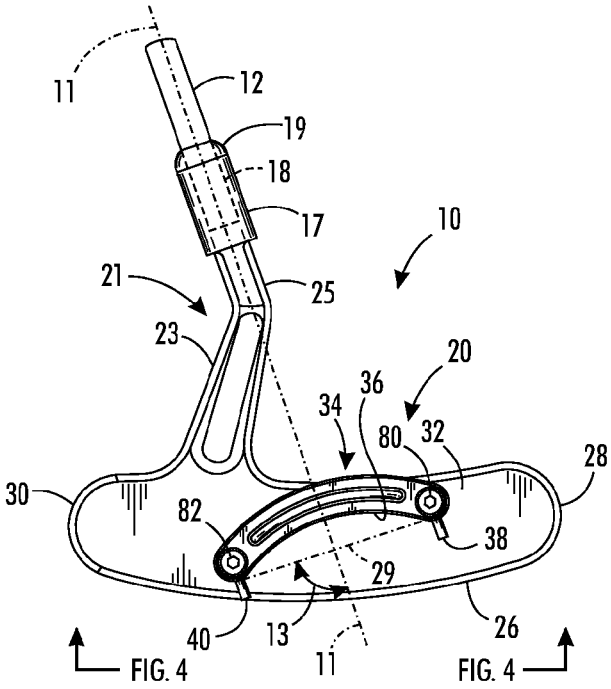
FIG. 3 is a rear elevation view of the club body and rearward member of the golf putter of FIG. 1.
Figure 4:
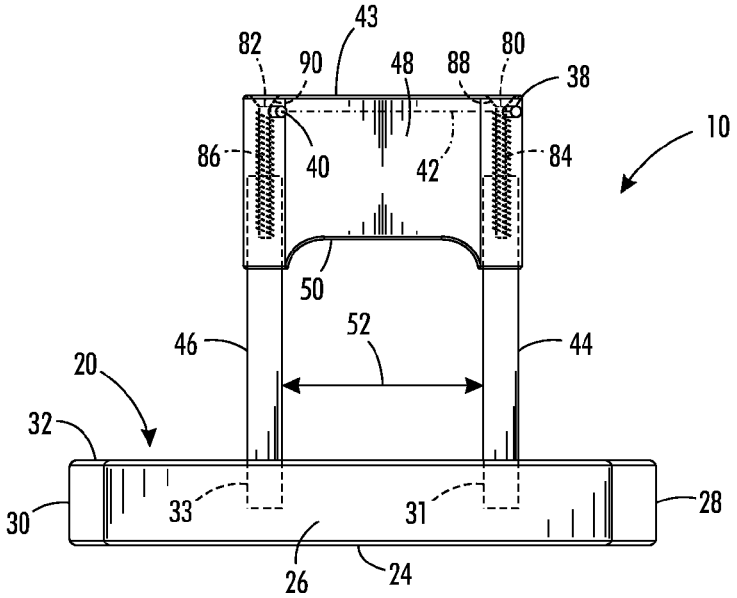
FIG. 4 is a bottom view of the club body and rearward member of the golf putter of FIG. 1 taken along the line 4-4 of FIG. 3.
Figure 5:
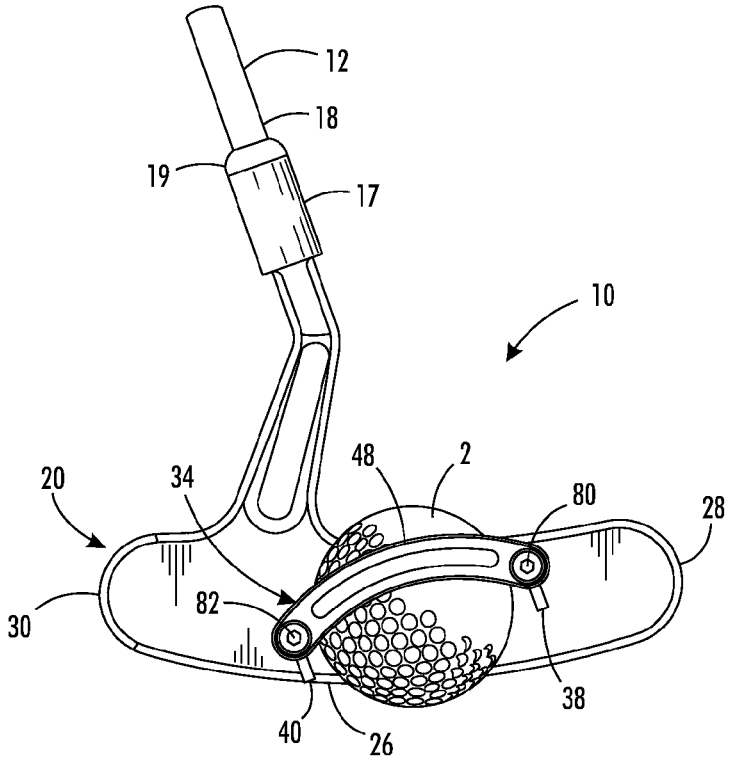
FIG. 5 is a rear elevation view of the club body and rearward member of the golf putter of FIG. 1, further depicting means for picking a golf ball up from a surface.

The proximal end 18 of the shaft 12 is joined to a top portion 21 of the club body 20. Referring to FIGS. 2 and 3, the top portion 21 may be comprised of a first upward extension 23 angled toward the toe end 28 of the body 20, which transitions to a second upward extension 25 angled toward the heel end 30 of the body 20. The second upward extension 25 of the top portion 21 of the body 20 may be joined to the proximal end 18 of the shaft 12 by a nozzle 17 and a ferrule 19, as is commonly done in golf club fabrication. The joining of the shaft 12 to the top portion 21 may utilize adhesive and/or an interference fit. Alternatively, as depicted in FIGS. 2 and 3 of the applicant's aforementioned U.S. provisional patent application Ser. No. 61/180,324, the proximal end of the shaft 12 may be disposed within a bore formed in a top surface of the body 20, and joined within the body by suitable means, such as a press fit, adhesive, welding, or soldering. Other configurations whereby the shaft 12 is joined to the top portion of the club body 20 may be suitable.

Figure 6:
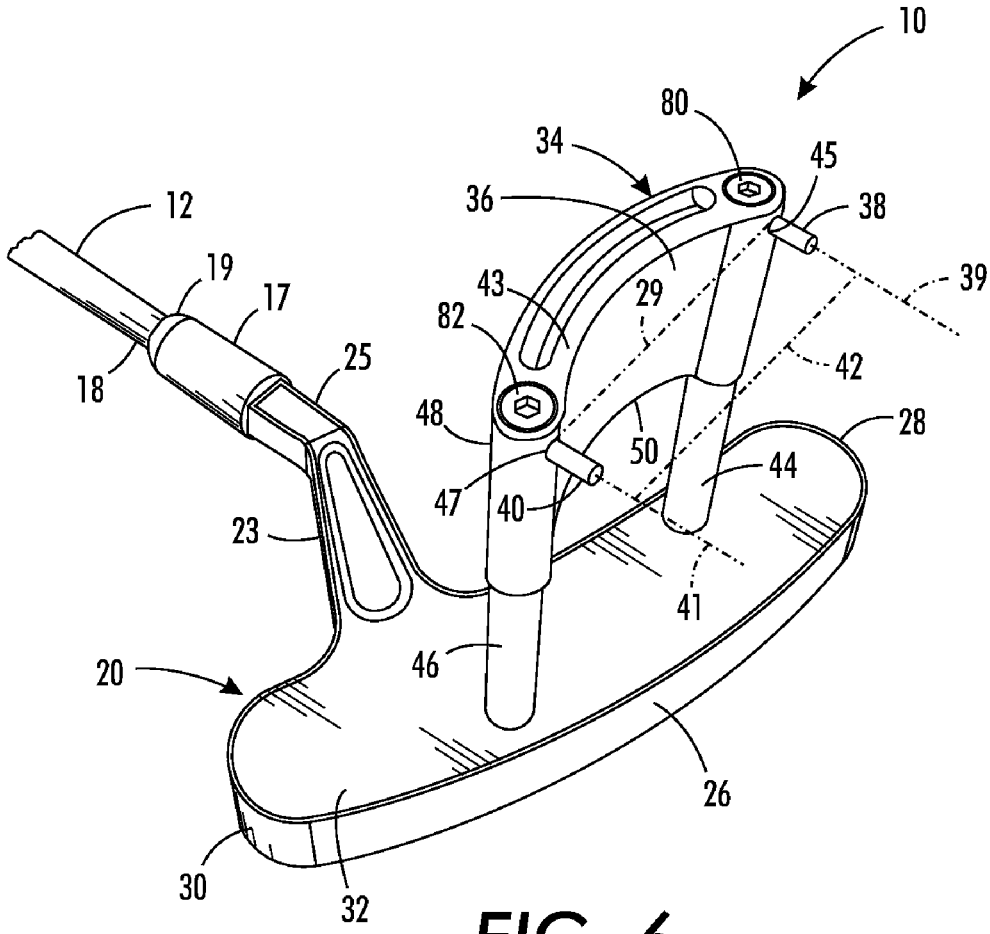
FIG. 6 is a lower heel-side perspective view of the club body and rearward member of the golf putter of FIG. 1.

Referring in particular to FIG. 2, the shaft 12 is tilted at an acute angle 13 with respect to a line segment 27 extending transversely from the extremities of the club body 20 at toe and heel surfaces 28 and 30. Referring also to FIGS. 3 and 6, the shaft 12 is joined to the club body 20 such that central axis 11 of the shaft 12 intersects a line segment 29 extending from a junction 45 of the first cleat 38 with the lower region 36 of the rearward member 34 to a junction 47 of the second cleat 40 with the lower region 36 of the rearward member 34. The angle 13 of the central axis 11 of the shaft 12 may be substantially perpendicular to the line segment 29. The central axis 11 of the shaft 12 may bisect the line segment 29. Such a geometric relationship facilitates the alignment of the body 20 of the club 10 by a golfer, as will be explained subsequently herein.

Figure 12A:
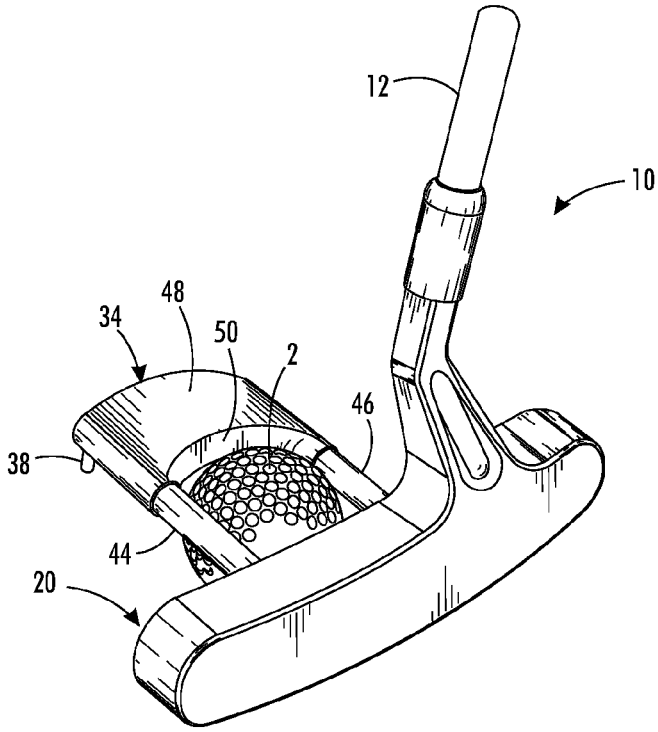
FIG. 12A is an upper front toe-side perspective view of the club body and rearward member of the golf putter, shown in the act of picking up a golf ball.
Figure 12B:
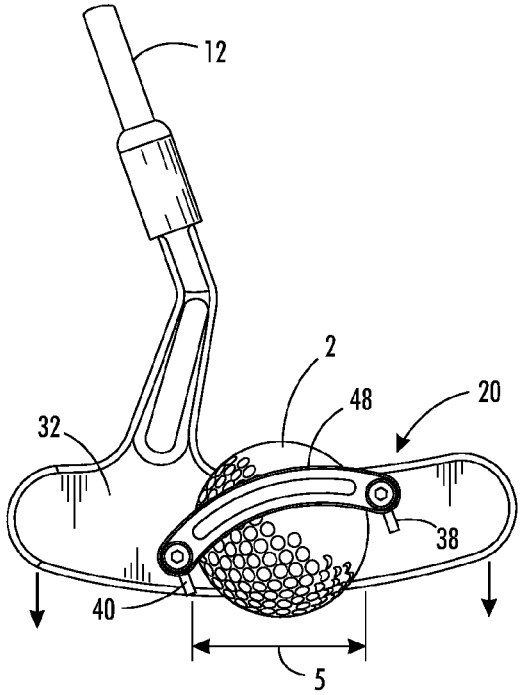
FIG. 12B is a rear elevation view of the club body and rearward member of the golf putter, shown in the act of picking up a golf ball.

Referring in particular to FIGS. 4-6, 12A, and 12B, the rearward member 34 of the golf putter 10 may be comprised of a first elongated rod 44, a second elongated rod 46, and a rearward block 48 joined at a front edge 50 thereof to the first and second elongated rods 44 and 46. The first and second elongated rods 44 and 46 and the rearward block 48 may form means for engaging with and removing a golf ball 2 from a surface such as a green (not shown) beneath the body 20 of the golf putter 10. In one embodiment, the first and second rods 44 and 46 may be substantially parallel, with the distance 52 between them being slightly less than the diameter 5 of a golf ball 2. This dimensioning will cause an interference fit of the golf ball 2 between the first and second elongated rods 44 and 46 when the club body 20 and rearward member 34 are forced downwardly over a golf ball 2 disposed between the first and second elongated rods 44 and 46, as shown in FIGS. 12A and 12B. In another embodiment, the first elongated rod 44, the second elongated rod 46, and the rearward block 48 may be dimensioned and arranged so as to cause an interference fit of a golf ball 2 between at least two of the first elongated rod 44, the second elongated rod 46, the front edge 50 of the rearward block 48, and the rearward surface 32 of the club body 20 when the club body 20 and rearward member 34 are forced downwardly over the golf ball 2 disposed between the first and second elongated rods 44 and 46. In other words, an interference fit of the golf ball between the first and second elongated rods 44 and 46, or between the front edge 50 of the rearward block 48, and the rearward surface 32 of the club body 20 can serve to pick up the golf ball; or an interference fit of the ball between any three of the first and second elongated rods 44 and 46, the front edge 50 of the rearward block 48, and the rearward surface 32 of the club body 20 can serve to pick up the golf ball; or an interference fit between all four elements can serve to pick up the golf ball.

Alternatively, the rearward member 34, including means for means for engaging with and removing a golf ball 2 may be as shown in FIGS. 3-6 and FIG. 11 in the applicant's aforementioned U.S. provisional patent application Ser. No. 61/180,324, the disclosure of which is incorporated herein by reference.

Referring again to FIGS. 3-6 in particular, the rearward member 34 may be made separately from the club body 20 and joined thereto. In the embodiment of the club 10 depicted in FIGS. 3-6, and as described previously, the rearward member 34 is comprised of a first elongated rod 44, a second elongated rod 46, and a rearward block 48. The respective elongated rods 44 and 46 may be threaded, and joined to the club body 20 by threading them into correspondingly threaded holes. Alternatively, the elongated rods 44 and 46 may be press fit into holes 31 and 33 in the body 20, or welded, or joined with adhesive.

The rearward block 48 may be joined to the elongated rods 44 and 46 by suitable fastening means such as e.g., screws. In the embodiment of the club 10 depicted in FIGS. 3-6, first and second screws 80 and 82 are tapered-head screws, and are disposed in respective bores 84 and 86, and countersinks 88 and 90.

In one embodiment, the club body 20 is made of aluminum, the rearward block 48 is made of brass, and the elongated rods 42 and 44 and cleats 38 and 41 are made of stainless steel. Other materials may be suitable. The cleats 38 and 40 may be joined to the rear member 34 by a press-fit into bores in the lower edges of the rear member, or by adhesive. Alternatively, the cleats 38 and 40 may be threaded, and may be screwed into threads formed in bores provided in the lower edges of the rear member 34. Alternatively, the cleats 38 and 40 may be formed integrally as a part of the rearward block 48. In one embodiment, the cleats are formed as elongated cylinders having a diameter of about ⅛ inch, and a length of about ¼ inch, although other lengths and diameters may be suitable. The club head body 20 and/or shaft 12 and/or grip 14 and/or rearward block 48 may include branding indicia, which is engraved, silkscreened, etched, or painted thereupon.

As disclosed in the applicant's U.S. provisional patent application Ser. No. 61/180,324, the golf club body 20 may further include a toe weight and a heel weight, which may be removably joined to the club body 20 by suitable fasteners. In that manner, a varied selection of weights may be provided, from which the golfer may select specific preferred weights to provide the desired "feel" of the club 10.

Figure 7:
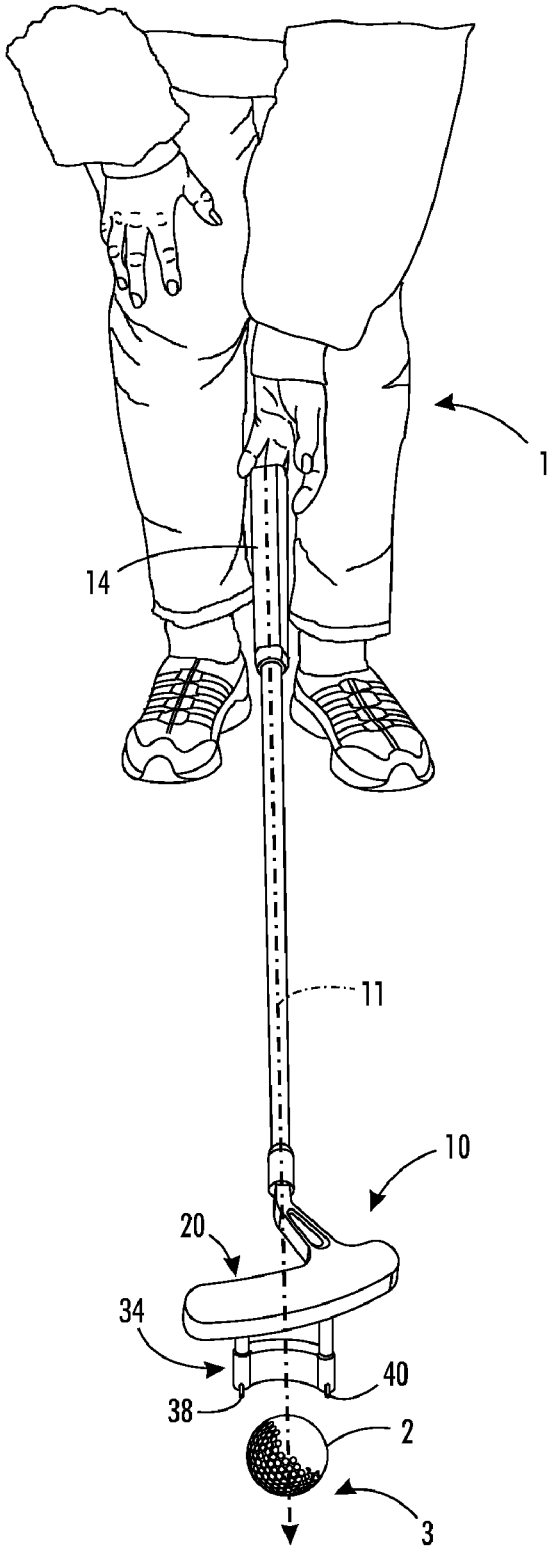
FIG. 7 is a front perspective view of a golfer in the act of aligning a putt with the golf putter of FIG. 1.

The method of use of the applicant's golf putter 10 will now be described, with reference in particular to FIGS. 7-11. Referring first to FIG. 7, the golfer 1 takes a position such that his ball 2 is on the green 3 between him, and the approximate target direction for his putt. He lowers himself by bending or squatting, and takes a line of sight down along the axis 11 of the shaft 12 of his putter 10, with his ball 2 along the line of sight. He holds the putter 10 with the distal end 14 of the shaft 12 in a lowered position, i.e. between approximately a "nine o'clock" and a "ten o'clock" position. The golfer 1 then observes the contour of the green 3 and chooses his "line" for the putt, which may be directly to the golf hole (not shown) if the green appears level, or which may be another direction to account for slope of the green 3. He aligns the shaft 12 of his putter 10 in the exact direction of his "line," also with his ball 2 along this line, by sliding the putter 10 along the green 3 as needed. It is noted that at this point, the distal end 43 of the rearward member 34 is the portion of the club that is in contact with the green 3, and that this distal end 43 is provided with a smooth surface, to facilitate sliding the club 10 on the green 3, without snagging or damaging the grass of the green 3.

Figure 8:
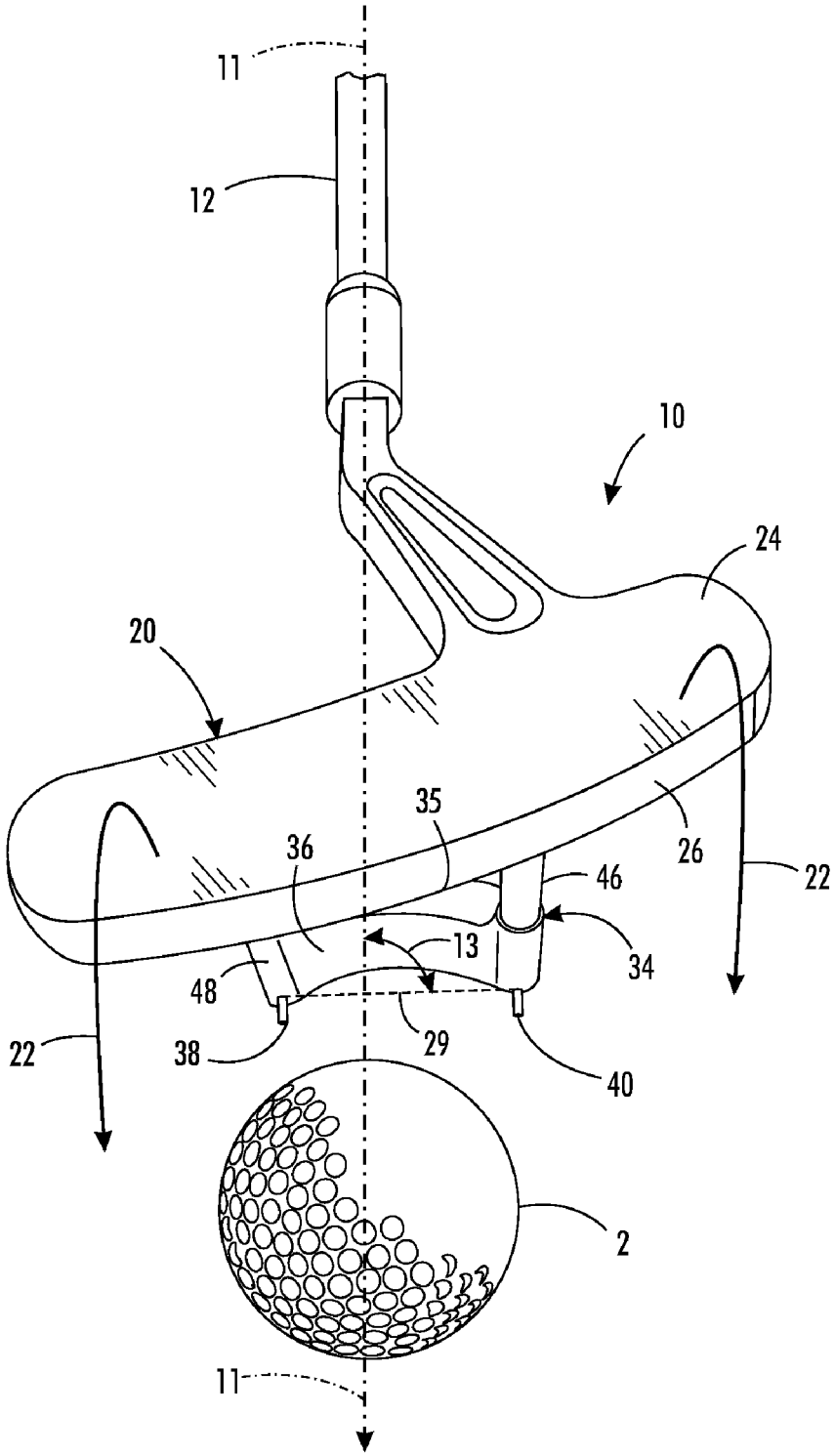
FIG. 8 is a front perspective view of the club body and rearward member of the golf putter, in a partially raised position.
Figure 9:
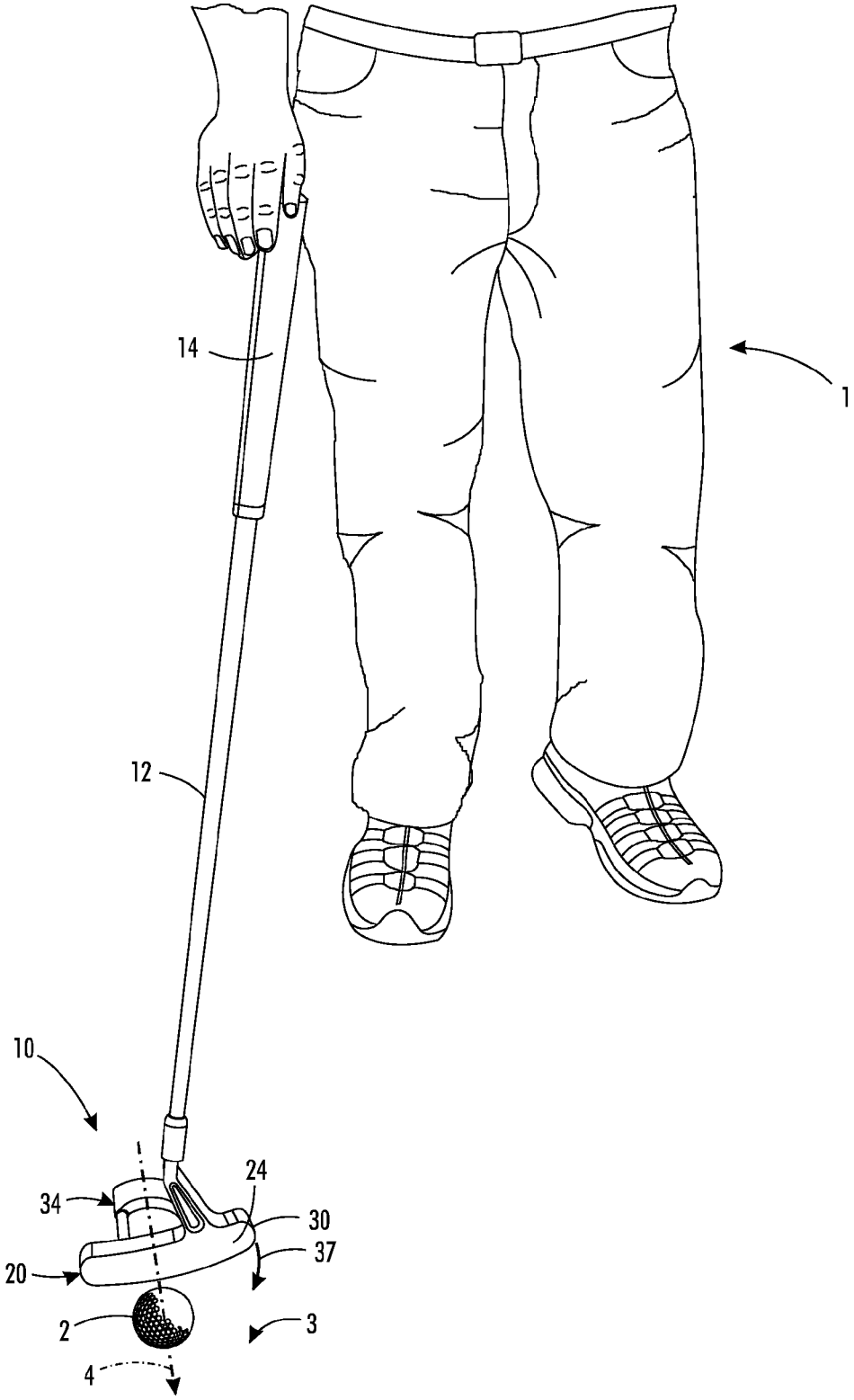
FIG. 9 is a front perspective view of the golfer in the act of aligning a putt with the golf putter completely raised to the upright position.

Referring now to FIG. 8, and FIG. 9 in sequence, the golfer 1 then proceeds to raise the distal (grip) end 14 of the shaft 12 of the putter 10 from the approximately nine o'clock/ten o'clock position, to a vertical, i.e., twelve o'clock position. As he raises the distal (grip) end 14 of the shaft 12, the face 24 of the club body tilts forward as indicated by arcuate arrows 22, and the cleats 38 and 40 sink and bite into the green 3, thereby preventing the club body 20 from slipping or twisting, and maintaining the alignment of the face 24 of the body in the transverse direction (see line segment 27 of FIG. 2) perpendicular to the putting line 4. As the club shaft 12 is pivoted upwardly, the two cleats 38 and 40, and the front edge 35 of the club body 20 may work as a tripod to provide further stability in this transition. When the putter shaft 12 is in the vertical position (FIG. 9), a portion of the lower surface 26 of the club body 20 is in contiguous contact with the green 3. Additionally, by virtue of the function of the cleats 38 and 40 during the transition of the club shaft 12 from angled to vertical, the front face 24 of the putter 10 is substantially perpendicular to the line 4 chosen by the golfer 1. This enables a more accurate putt. It is to be understood that the cleats 38 and 40 may not be as elongated and as sharp as shown in FIGS. 3-6. The cleats may be shorter, and may also have shapes other than cylindrical extending from the lower region 36 of the rearward member 34. The cleats 38 and 40 may be of various shapes, so long as they provide sufficient resistance to prevent the club body 20 from sliding on the green 3 during the transition of the club shaft 12 from the lowered position to the vertical position.

Figure 10:
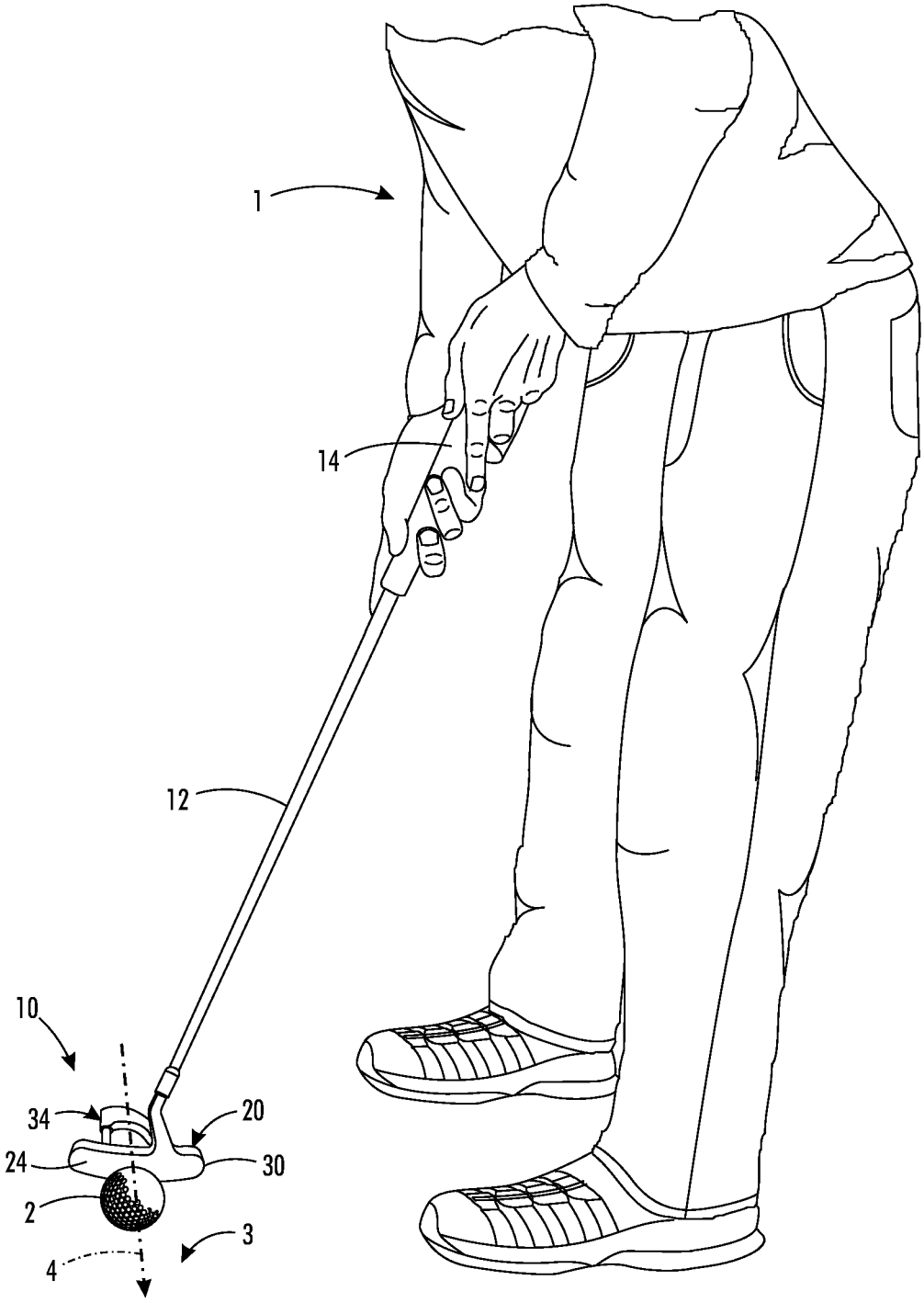
FIG. 10 is a front perspective view of the golfer immediately prior to the act of performing a putt.
Figure 11:
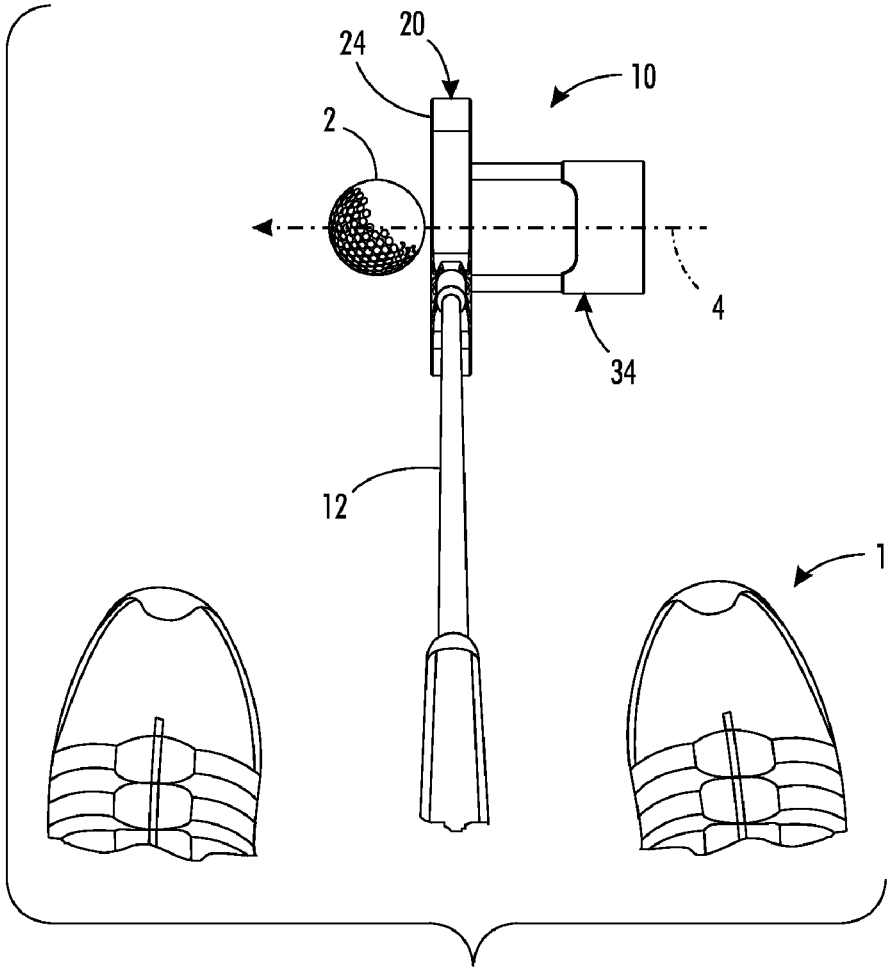
FIG. 11 is a top (golfer's) view of the golf putter, in the putting position of FIG. 10.

Referring to FIGS. 10 and 11, with the putter shaft 12 fully raised and vertical, the golfer 1 steps to the heel side of the putter 10. When he does this, the cleats 38 and 40 maintain a bite in the green 3, keeping the putter 10 in the desired alignment. The golfer 1 then grasps the grip 14 of the club shaft 12, and assumes a putting stance, moving the club shaft 12 slightly towards himself, thereby lowering the heel 30 of the club body 20 (as indicated by arrow 37 of FIG. 9) to a point such that the heel 30 is slightly lowered and the toe 28 is slightly raised, substantially as shown in FIG. 2. It is noted that the face 24 of the club body 20 is in the best position, i.e. it has been maintained substantially perpendicular to the chosen line 4 when the club shaft 12 is tilted to the correct putting position as shown in FIGS. 10 and 11.

Referring again to FIGS. 9-11, it can be seen that the provision of the cleats 38 and 40 at the distal end of the rearward member 34, and the front edge 35 of the club body 20 enable the putter 10 to stand up by itself in the putting position on a green 3. However, when the putter 10 is further tilted forward slightly to perform a putting stroke, the cleats 38 and 40 disengage with the green 3, thereby permitting a smooth stroke.

It is noted that one function of the rearward member 34 is to provide a pair of cleats at the lower region 36 thereof, which bite into the green during the process of aligning a putt. However, the rearward member may be provided with additional useful functionality. As has been explained previously, the rearward member 34 may further comprise means to pick up a golf ball from a surface. In that manner, if a golfer strokes a putt to within a few inches of the hole (i.e., such that the remaining putt is considered a "gimme"—in a friendly round), the golfer can thus pick up his ball 2 with his putter 10 without bending over, simply by using the ball picking means of the putter 10.

It is, therefore, apparent that there has been provided, in accordance with the present invention, a golf putter which enables more accurate putting by a golfer. Having thus described the basic concept of the invention, it will be rather apparent to those skilled in the art that the foregoing detailed disclosure is intended to be presented by way of example only, and is not limiting. Various alterations, improvements, and modifications will occur and are intended to those skilled in the art, though not expressly stated herein. These alterations, improvements, and modifications are intended to be suggested hereby, and are within the spirit and scope of the invention. Additionally, the recited use of numbers, letters, or other designations therefore, is not intended to limit the claimed processes to any order except as may be specified in the claims.

I claim:

1. A golf club comprised of a body including a front face; a rearward member joined to and extending rearwardly from the body and comprising a lower region, and a first cleat and a second cleat extending downwardly from the lower region; and a shaft joined to a top portion of the body and having a central axis which intersects a line segment extending from a junction of the first cleat with the lower region of the rearward member to a junction of the second cleat with the lower region of the rearward member.

2. The golf club as recited in claim 1, wherein the first cleat extends downwardly along a first cleat axis, and the second cleat extends downwardly along a second cleat axis and wherein a line segment extending from the first cleat axis to the second cleat axis is parallel to the front face of the club body.

3. The golf club as recited in claim 1, wherein the central axis of the shaft is substantially perpendicular to the line segment extending from the junction of the first cleat with the lower region of the rearward member to the junction of the second cleat with the lower region of the rearward member.

4. The golf club as recited in claim 1, wherein the central axis of the shaft bisects the line segment extending from the junction of the first cleat with the lower region of the rearward member to the junction of the second cleat with the lower region of the rearward member.

5. The golf club as recited in claim 1, wherein the rearward member is comprised of a first elongated rod, a second elongated rod, and a rearward block joined at a front edge thereof to the first and second elongated rods.

6. The golf club as recited in claim 5, wherein the first and second rods are substantially parallel, and the distance between the first and second elongated rods is slightly less than the diameter of a golf ball, so as to cause an interference fit of the golf ball between the first and second elongated rods when the club body and rearward member are forced downwardly over a golf ball disposed between the first and second elongated rods.

7. The golf club as recited in claim 5, wherein the first elongated rod, the second elongated rod, and the rearward block are dimensioned and arranged so as to cause an interference fit of a golf ball between at least two of the first elongated rod, the second elongated rod, the front edge of the rearward block, and a rearward surface of the club body when the club body and rearward member are forced downwardly over a golf ball disposed between the first and second elongated rods.

8. A golf club comprised of a body including a front face; and a rearward member comprised of a first elongated rod extending rearwardly from the body, a second elongated rod extending rearwardly from the body, and a rearward block joined at a front edge thereof to the first and second elongated rods, the rearward block comprising a lower region, and a first cleat and a second cleat extending downwardly from the lower region.

9. The golf club as recited in claim 8, wherein the first cleat extends downwardly along a first cleat axis, and the second cleat extends downwardly along a second cleat axis and wherein a line segment extending from the first cleat axis to the second cleat axis is parallel to the front face of the club body.

10. The golf club as recited in claim 8, further comprising a shaft joined to a top portion of the body and having a central axis which intersects a line segment extending from a junction of the first cleat with the lower region of the rearward member to a junction of the second cleat with the lower region of the rearward member.

11. The golf club as recited in claim 10, wherein the central axis of the shaft is substantially perpendicular to the line segment extending from the junction of the first cleat with the lower region of the rearward member to the junction of the second cleat with the lower region of the rearward member.

12. The golf club as recited in claim 10, wherein the central axis of the shaft bisects the line segment extending from the junction of the first cleat with the lower region of the rearward member to the junction of the second cleat with the lower region of the rearward member.

13. The golf club as recited in claim 8, wherein the first and second rods are substantially parallel, and the distance between the first and second elongated rods is slightly less than the diameter of a golf ball, so as to cause an interference fit of the golf ball between the first and second elongated rods when the club body and rearward member are forced downwardly over a golf ball disposed between the first and second elongated rods.

14. The golf club as recited in claim 8, wherein the first elongated rod, the second elongated rod, and the rearward block are dimensioned and arranged so as to cause an interference fit of a golf ball between at least two of the first elongated rod, the second elongated rod, the front edge of the rearward block, and a rearward surface of the club body when the club body and rearward member are forced downwardly over a golf ball disposed between the first and second elongated rods.

15. A golf club comprised of a body including a front face; a rearward member joined to and extending rearwardly from the body and comprising a lower region, and a first cleat and a second cleat extending downwardly from the lower region; and means for engaging with and removing a golf ball from a surface beneath the body of the golf club.

16. The golf club as recited in claim 15, wherein the means for engaging with and removing the golf ball is comprised of a first elongated rod and a second elongated rod separating a rearward block from a rearward surface of the club body.

17. The golf club as recited in claim 16, wherein the first and second rods are substantially parallel, and the distance between the first and second elongated rods is slightly less than the diameter of a golf ball, so as to cause an interference fit of the golf ball between the first and second elongated rods when the club body and rearward member are forced downwardly over the golf ball disposed between the first and second elongated rods.

18. The golf club as recited in claim 16, wherein the first elongated rod, the second elongated rod, and the rearward block are dimensioned and arranged so as to cause an interference fit of a golf ball between at least two of the first elongated rod, the second elongated rod, the front edge of the rearward block, and a rearward surface of the club body when the club body and rearward member are forced downwardly over the golf ball disposed between the first and second elongated rods.

19. A golf club comprised of a body including a front face; and a rearward member comprised of a first elongated rod extending rearwardly from the body, a second elongated rod extending rearwardly from the body, and a rearward block joined at a front edge thereof to the first and second elongated rods, the rearward block comprising a lower region, and a first cleat extending downwardly from the lower region.

20. The golf club as recited in claim 19, wherein the first elongated rod, the second elongated rod, and the rearward block are dimensioned and arranged so as to cause an interference fit of a golf ball between at least two of the first elongated rod, the second elongated rod, the front edge of the rearward block, and a rearward surface of the club body when the club body and rearward member are forced downwardly over a golf ball disposed between the first and second elongated rods.

* * * * *